United States Patent [19]

Kiefer et al.

[11] 4,221,226

[45] Sep. 9, 1980

[54] HOT MELT ADHESIVE FOR BONDING FILTER TOW, AND FILTER ELEMENTS BONDED THEREBY

[75] Inventors: John E. Kiefer, Kingsport, Tenn.; Robert C. Mumpower, II, Bristol, Va.

[73] Assignee: Eastman Kodak Company, Rochester, N.Y.

[21] Appl. No.: 12,413

[22] Filed: Feb. 15, 1979

[51] Int. Cl.[3] ..... A24D 3/08; A24D 3/14

[52] U.S. Cl. ..... 131/267

[58] Field of Search ..... 131/267; 260/28.5 A

*Primary Examiner*—V. Millin

*Attorney, Agent, or Firm*—Malcolm G. Dunn; Daniel B. Reece, III

[57] ABSTRACT

A hot melt adhesive having low viscosity and very low tackiness at application temperatures for bonding crystalline and amorphous fibers at their contact points in a cigarette tobacco smoke filter element, the hot melt adhesive being a blend of about 25 to about 75 weight percent wax and about 75 to about 25 weight percent of a tackifying hydrocarbon resin; and tobacco smoke filter elements bonded by the hot melt adhesive.

8 Claims, No Drawings

HOT MELT ADHESIVE FOR BONDING FILTER TOW, AND FILTER ELEMENTS BONDED THEREBY

The present invention is directed to a hot melt adhesive for textile tow, particularly for textile tow from which tobacco smoke filter rods are manufactured, and to tobacco smoke filter elements as bonded by the hereindisclosed hot melt adhesive.

Tobacco smoke filters are most commonly manufactured from a crimped textile tow of cellulose acetate fibers. The tow is "bloomed" in a known manner to separate the fibers, and a high boiling solvent, commonly called a "plasticizer", is applied by spraying, wicking, or other suitable means. The treated tow is then pulled into a cylindrical form and wrapped with paper. During an interval of time, which can be accelerated by heating, the plasticizer first partially dissolves the surface of the fibers causing them to become sticky and to bond together at points of contact with each other. The plasticizer then migrates into the fiber leaving the surface dry, but the fibers still remain bonded.

The bonding step, as described above, is critical to the filter rod making process. Without bonding, the filters are soft and difficult to process into filter cigarettes. When unbonded filters are cut, fibers tend to pull out of the center portion and thus present an unsightly appearance. Also, the short fibers formed during the cutting operation tend to dislodge and may even fall out of an unbonded filter into the smoker's mouth.

Since the above-described filter making process requires partial solvation of the fiber surface, it is applicable only to essentially noncrystalline fibers such as cellulose diacetate. Other common fibers such as those made from cotton, viscose, polyethylene, polypropylene, and poly(ethylene terephthalate) cannot be bonded by this method. Certain properties of these fibers such as strength, economics, and capability to be made into fine fibers indicate that they would be desirable fibers for tobacco smoke filters if a method for bonding them were available.

There have been several methods suggested for manufacturing tobacco smoke filters from tows other than secondary cellulose acetate. They include wrapping the tow of fibers with heavy paper or with an impervious thermoplastic sheath (U.S. Pat. No. 3,361,137) which result in firm filters that can be transported and processed at high speeds, but the filters do not cut smoothly. Short fibers produced in the cutting operation are not bonded to the filter matrix and consequently may fall out of the filter into the smoker's mouth. Also, the impervious coatings that these materials impart to the periphery of the filter are not readily adaptable to forming ventilation holes that are commonly used to produce "low tar and nicotine" cigarettes.

U.S. Pat. No. 2,904,050 discloses the use of wax, or a combination of wax and plasticizer to bond fibers into cigarette filters. When this process is used to bond synthetic fibers such as polypropylene, the hardness of the filter is marginal at best.

Various thermoplastic and water and solvent based adhesives, such as are used to produce nonwoven fabrics, bond fibrous materials into cigarette filters. These adhesives, however, adhere to the rolls and belts of the filter-making machinery, thus making high speed production impossible.

SUMMARY OF THE INVENTION

The invention, therefore, is directed to a hot melt adhesive that has a very low viscosity and very low tackiness while in the molten state, but has very good adhesion to either crystalline or amorphous fibers at ambient temperatures, and to a tobacco smoke filter element the fibers of which are bonded together at their contact points with such hot melt adhesive.

In this manner, tobacco smoke filters may be made from crimped textile tows of either crystalline or amorphous fibers, such fibers as from cellulose acetate, poly(ethylene terephthalate), polypropylene and polyethylene polymers.

The hot melt adhesive disclosed herein may be a blend of about 25 to about 75 weight percent wax and about 75 to about 25 weight percent of a tackifying resin, and preferably about 50 weight percent wax and about 50 weight percent tackifying resin, the blend having a melt viscosity at application temperatures ranging from about 100° C. to about 200° C. of less than about 50 centipoises. The melt viscosities in this invention were measured using the ASTM procedure (D1824)26 and a Thermosel Model LVT viscometer. The wax may be selected from a group comprising paraffin wax having a melting point from about 55° C. to about 71° C., a microcrystalline wax having a melting point from about 62° C. to about 77° C., and a Fischer-Tropsch hydrocarbon wax having a melting point from about 83° C. to about 103° C. The tackifying resin may be selected from a group comprising hydrocarbon resins and polyterpene resins having a ring and ball softening point from about 100° C. to about 140° C.

The tobacco smoke filter element disclosed herein may be comprised of filamentary tow selected from filaments of cellulose acetate, poly(ethylene terephthalate), polypropylene and polyethylene, the filaments being bonded together into a self-supporting filter element having a permeable surface with a hot melt adhesive that may be a blend of about 25 to about 75 weight percent wax and about 75 to about 25 weight percent of a tackifying resin, with the blend having a melt viscosity at application temperatures of about 100° C. to about 200° C. of less than about 50 centipoises. The wax may be selected from a group comprising a paraffin wax having a melting point from about 55° C. to about 71° C., a microcrystalline wax having a melting point from about 62° C. to about 77° C., and a Fischer-Tropsch wax having a melting point from about 83° C. to about 103° C. The tackifying resin may be selected from the group comprising hydrocarbon resins and polyterpene resins having a ring and ball softening point from about 100° C. to about 140° C.

DESCRIPTION OF THE PREFERRED INVENTION

The hot melt wax adhesive is formulated from a wax and a modifier, the modifier being a tackifying resin.

The wax must be nontacky and have a low viscosity at the application temperatures. Paraffin wax, for instance, is a low cost, readily available wax that performs well. For instance, a product called "Gulfwax" from Gulf Oil Company which is commonly used in canning foods, etc., is found to be effective. It has a melting point from about 55° C. to about 71° C. Another wax is PARAFLINT H-1 (formerly called PARAFLINT RG, a Fischer-Tropsch hydrocarbon wax, Moore & Munger, Inc., of Connecticut), which has a melting point from about 83° C. to about 103° C. Still another may be, for instance, Shellwax microcrystalline waxes, grade 500, having a melting point of about 62° C., a product of Shell Chemical Company, a division of Shell Oil Company.

The tackifying resins useful in this invention can be a hydrocarbon resin such as DAC-B hydrocarbon resin prepared according to the process disclosed in U.S. Pat. No. 3,701,760, (DAC-B is also identified in U.S. Pat. 3,437,629) as well as other hydrocarbon resins, polyterpenes or terpene polymers, rosin esters and the like. One such hydrocarbon tackifying resin is a hydrocarbon resin having a softening point of 100° C. and available commercially as "Resin H-100" from Eastman Chemical Products, Inc. Another one is a hydrocarbon resin having a softening point of 130° C. and is available commercially as "Resin H-130", also from Eastman Chemical Products, Inc. Other hydrocarbon tackifying resins can be prepared by the polymerization of monomers consisting primarily of olefins and diolefins and include, for example, the residual by-product monomers resulting from the manufacture of isoprene. These hydrocarbon tackifying resins typically exhibit a ring and ball softening point of from about 5° to 125° C.; an acid number of from 0 to 2; and an iodine value of from about 75 to 125. Examples of such commercially available resins of this type are "Wingtack" 10 and "Wingtack" 95 as sold by the Goodyear Tire and Rubber Company and the Sta-Tac and Betaprene 14 resins sold by the Reichhold Chemical Corporation.

An example of a polyterpene is one marketed by Hercules, Inc. under the same "Piccolyte" C135 resin.

Additives such as powdered zinc oxide or carbon may be added to the hot melt adhesive to increase the efficiency of the filter for removing selected components from the smoke stream. The addition of carbon particles to the hot melt adhesive may also serve to absorb heat from infrared heaters stationed along the tow line and hence increase the efficiency of the thermal bonding process.

Copolymers such as ethylene-vinylacetate may also be added to increase the brittleness of the bond. The concentration of these materials, however, must generally be kept low because excessive amounts increase the viscosity of the hot melt adhesive. Excessive polymer also tends to increase thickness of the hot melt adhesive. A tacky hot melt adhesive adheres to the delivery rolls and other parts of the filter making machinery.

The hot melt adhesive may be applied to a moving tow band of fibers by any convenient method. For instance, it may be applied with a heated spray gun or it may be wicked or applied by a dip roll. It may also be applied from a centrifugal applicator such as a wheel or circular brush rotating at a high speed. The treated tow may be compacted into a continuous cylindrical rod by conventional type filter making machinery. The continuous filter rod may be paper-wrapped and cut into convenient lenghts for attaching as "filter elements" to cigarettes. If the temperatures are controlled carefully, however, paper wrap is not needed.

An alternate method of treating fibrous tows is to apply the hot melt adhesive as described above, allow it to cool and solidify, then compact the fibrous band with conventional filter making equipment. A source of heat is supplied to the filter maker sufficient to remelt the adhesive. The band of fibers is subsequently cooled to effect resolidification and bonding.

The temperature for application may be about 100° C. to about 200° C., and preferably about 150° C. The viscosity at such application temperatures should be less than about 50 centipoises.

The invention can be further illustrated by the following examples of preferred embodiments thereof, although it will be understood that these examples are included merely for purposes of illustration and are not intended to limit the scope of the invention unless otherwise specifically indicated.

EXAMPLE 1

A bloomed tow of 2.8 denier/filament 38,000 total denier cellulose acetate fibers was sprayed with a hot melt adhesive (150° C.) consisting of 50% Paraflint H-1 formerly called Paraflint RG wax (Fischer-Tropsch hydrocarbon wax) and 50% Resin H-130 (EASTMAN® Hydrocarbon Resin). The viscosity of the adhesive was 17 centipoises at 150° C. (Brookfield Viscometer). The spray gun was heated to 150° C. in order to keep the adhesive a liquid until after it was deposited on the tow. The fine particles were firmly attached to the fibers and were not tacky. The treated tow contained 16% adhesive and was converted to cigarette filter rods by a conventional filter rod making apparatus containing a steam curing chamber followed by an air cooling chamber. The resulting filter rods were firm, well bonded and were easily cut into filter elements or tips for attaching to cigarettes.

EXAMPLE 2

A crimped 3.5 denier/filament 55,000 total denier poly(ethylene terephthalate) tow was bloomed and treated in the same manner as Example 1. The resulting filters contained 20% adhesive, were firm, well bonded, and were easily cut into filter tips for attaching to cigarettes.

EXAMPLE 3

A crimped tow of 4.0 denier/filament 25,000 total denier polypropylene tow was bloomed and treated in the same manner as in Example 1. The resulting filters contained 10% adhesive. They were firm, well bonded, and were easily cut into filter tips for attaching to cigarettes.

EXAMPLE 4

A crimped 4.0 denier/filament 25,000 total denier polypropylene tow was bloomed and sprayed with a molten bonding agent (150° C.) consisting of 50% paraffin wax ("Gulfwax", a product of Gulf Oil Company) and 50% Resin H-130 (EASTMAN® Hydrocarbon Resin). The viscosity of the adhesive was seven centipoises at 150° C. (Brookfield Viscometer). The temperature of the spray gun was maintained at 150° C. in order to keep the adhesive a liquid until it was deposited on the fibers. The treated tow contained 13% adhesive and was not tacky and did not contain loose particles. The treated tow was converted to filter rods by a conventional filter rod making apparatus containing a steam curing chamber followed by an air cooling chamber. The resulting filters were firm, well bonded, and could easily be cut into filter tips.

EXAMPLE 5

A molten hot-melt adhesive (150° C.) consisting of 50% paraffin wax ("Gulfwax", a product of Gulf Oil Company) and 50% polyterpene resin ("Piccolyte"

C-135 resin) was sprayed on bloomed 4.0 denier/filament 25,000 polypropylene tow. The treated tow containing 10% adhesive was converted to filter rod in the same manner as Example 4. The resulting filters were firm, well-bonded, and could easily be cut into filter tips.

EXAMPLE 6

Tobacco smoke filters were prepared on a production type filter making machine equipped with a brush applicator of the type commonly used to apply plasticizer to cellulose acetate tow. A bonding agent consisting of 50% paraffin wax ("Gulfwax", a product of Gulf Oil Company) and 50% Eastman H-130 Resin was heated to 150° C. in the brush applicator and applied to a moving tow band of cellulose acetate fibers. The delivery rolls and the tow band were heated with infrared heating lamps to maintain a tow temperature of about 100° C. After the tow was recompacted and paper wrapped, it was allowed to cool to room temperature. The filter rods made by this process contained 8 to 15% hot melt adhesive, were firm, and were easily cut into filter tips.

EXAMPLE 7

Filter rods were prepared from crimped 3.9 denier/filament 35,000 total denier polyethylene tow using the same hot melt adhesive as Example 4. The treated tow contained 11% adhesive and did not contain loose particles. The treated tow was converted to filter rods as described in Example 4. The resulting rods were firm, well-bonded and could easily be cut into filter tips.

EXAMPLE 8

A crimped 4 denier/filament 25,000 total denier polypropylene tow was bloomed and sprayed with a molten bonding agent (150° C.) consisting of 45% parafin wax (Gulfwax, a product of Gulf Oil Company), 45% Resin H-130 (Eastman® Hydrocarbon Resin), and 10% Elvac 220 (a ethylene vinyl acetate copolymer made by Du Pont). The viscosity of the adhesive was 51 centipoises at 150° C. (Brookfield Viseometer). The application temperature was 150° C. in order to keep the adhesive a liquid until it was deposited on the fibers. The treated tow was not tacky and was converted to filter rod in the same manner as Example 4. The resulting rods were firm and could easily be cut into filter rods.

It will be noted in Example 8 that the addition of ethylene-vinylacetate tended to increase the viscosity of the hot melt adhesive as compared to the viscosities shown in Examples 1–7.

EXAMPLE 9

A crimped 4.0 denier/filament 25,000 total denier polypropylene tow was bloomed and sprayed with a molten bonding agent (150° C.) consisting of 50% microcrystalline wax (Shellmax microcrystalline wax, grade 500, a product of Shell Chemical Company, a division of Shell Oil Company of 50% Resin H-130 (EASTMAN® Hydrocarbon Resin). The temperature of the spray gun was maintained at 150° C. in order to keep the adhesive a liquid until it was deposited on the fibers. The treated tow contained 13% adhesive and was not tacky and did not contain loose particles. The treated tow was converted to filter rods by a conventional filter rod making apparatus containing a steam curing chamber followed by an air cooling chamber. The resulting filters were firm, well bonded, and could easily be cut into filter tips.

The invention has been described in detail with particular reference to preferred embodiments thereof, but it will be understood that variations and modifications can be effected within the spirit and scope of the invention.

We claim:

1. A tobacco smoke filter element comprised of filamentary tow selected from filaments of cellulose acetate, poly(ethylene terephthalate), polypropylene and polyethylene, said filaments being bonded together into a self-supporting filter element having a permeable surface with a hot melt adhesive comprising a blend of about 25 to about 75 weight percent wax and about 75 to about 25 weight percent of a tackifying resin, the blend having a melt viscosity at application temperatures ranging from about 100° C. to about 200° C. of less than about 50 centipoises, wherein said wax is selected from the group consisting of paraffin wax having a melting point from about 55° C. to about 71° C., a microcrystalline wax having a melting point from about 62° C. to about 77° C., and a Fischer-Trospsh hydrocarbon wax having a melting point from about 83° C. to about 103° C., and wherein the tackifying resin is selected from the group consisting of hydrocarbon resins and polyterpene resins having a ring and ball softening point from about 100° C. to about 140° C.

2. A tobacco smoke filter element as defined in claim 1, wherein said hot melt adhesive comprises about 50 weight percent of said wax and about 50 weight percent of said tackifying resin.

3. A tobacco smoke filter element as defined in claim 2, wherein said hot melt adhesive comprises a paraffin wax and a hydrocarbon resin having a ring and ball softening point of about 130° C.

4. A tobacco smoke filter element as defined in claim 1, wherein said hot melt adhesive comprises a microcrystalline wax and a hydrocarbon resin having a ring and ball softening point of about 130° C.

5. A tobacco smoke filter element as defined in claim 2, wherein said hot melt adhesive comprises a Fischer-Trospch hydrocarbon wax and a hydrocarbon resin having a ring and ball softening point of about 130° C.

6. A tobacco smoke filter element as defined in claim 2, wherein said hot melt adhesive comprises a paraffin wax and a polyterpene resin having a ring and ball softening point of about 135° C.

7. A tobacco smoke filter element as defined in claim 2, wherein said hot melt adhesive comprises a microcrystalline wax and a polyterpene resin having a ring and ball softening point of about 135° C.

8. A tobacco smoke filter element as defined in claim 2, wherein said hot melt adhesive comprises a Fischer-Tropsch hydrocarbon wax and a polyterpene resin having a ring and ball softening point of about 135° C.

* * * * *

UNITED STATES PATENT AND TRADEMARK OFFICE

CERTIFICATE OF CORRECTION

PATENT NO. : 4,221,226

DATED : September 9, 1980

INVENTOR(S) : John E. Kiefer et al.

It is certified that error appears in the above—identified patent and that said Letters Patent is hereby corrected as shown below:

Column 6, Claim 1, line 27, "Trospsh" should read -- Tropsch --.

Column 6, Claim 4, line 42, "1" should read -- 2 --.

Column 6, Claim 5, line 3, "Trospch" should read -- Tropsch --.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*